US007038973B1

(12) United States Patent
Merlino

(10) Patent No.: US 7,038,973 B1
(45) Date of Patent: May 2, 2006

(54) HANDHELD DATA DEVICE WITH CELLULAR CONNECTIVITYS

(76) Inventor: Angelo Merlino, 4 Fowler Ct., Red Bank, NJ (US) 07701

( * ) Notice: Subject to any disclaimer, the term of this patent is extended or adjusted under 35 U.S.C. 154(b) by 346 days.

(21) Appl. No.: 10/436,469

(22) Filed: May 12, 2003

(51) Int. Cl.
*G04F 8/00* (2006.01)
*G04F 10/00* (2006.01)

(52) U.S. Cl. ..... 368/2; 368/110; 368/113; 340/323 R; 455/3.06

(58) Field of Classification Search ..... 368/10, 368/88, 89, 107, 14, 113, 121, 276, 47, 2, 368/110; 463/6; 340/323 R; 455/3.06
See application file for complete search history.

(56) References Cited

U.S. PATENT DOCUMENTS 3,789,600 A 2/1974 Champan
5,134,565 A 7/1992 Herbertz
5,696,706 A * 12/1997 Morton et al. ..... 702/142
5,719,825 A 2/1998 Dotter
5,812,049 A * 9/1998 Uzi ..... 340/323 R
5,848,030 A 12/1998 Sullivan
5,946,635 A * 8/1999 Dominguez ..... 455/558
D413,817 S 9/1999 Ando et al.
6,035,035 A 3/2000 Firooz
6,072,751 A * 6/2000 Kirson et al. ..... 368/2
6,449,583 B1 * 9/2002 Sakumoto et al. ..... 702/179
6,556,222 B1 * 4/2003 Narayanaswami ..... 715/786
6,700,494 B1 * 3/2004 Dowd ..... 340/573.3
6,712,701 B1 * 3/2004 Boylan et al. ..... 463/42
6,860,806 B1 * 3/2005 Kojima et al. ..... 463/6

* cited by examiner

*Primary Examiner*—Kamand Cuneo
*Assistant Examiner*—Jeanne-Marguerite Goodwin

(57) ABSTRACT

A handheld data device with cellular connectivitys for facilitating tracking of training and handicapping for horses. The handheld data device with cellular connectivitys includes a housing, designed for being grasped by a human hand, which includes a front wall and defines an interior space, a processing and storage means preferably positioned within the housing, and timing means used for determining an elapsed time, and also positioned within the housing. The timing means facilitates timing of a horse. A plurality of actuators are operationally coupled to the timing means and facilitates indication of a start time, a stop time, and a split/lap for the timing means. A stop watch display may be positioned on the front wall. The stop watch display is operationally coupled to the timing means and provides a visual indication of an elapsed time.

17 Claims, 3 Drawing Sheets

HANDHELD DATA DEVICE WITH CELLULAR CONNECTIVITYS

BACKGROUND OF THE INVENTION

1. Field of the Invention

The present invention relates to handheld computing devices and personal data assistants and more particularly pertains to a new handheld data device with cellular connectivitys for facilitating tracking of training and handicapping for horses.

2. Description of the Prior Art

The use of handheld computing devices and personal data assistants is known in the prior art. More specifically, handheld computing devices and personal data assistants heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,035,035; U.S. Pat. No. 5,719,825; U.S. Pat. No. 5,134,565; U.S. Pat. No. 3,789,600; U.S. Pat. No. 5,848,030; and U.S. Pat. No. Des. 413,817.

While these devices fulfill their respective, particular objectives and requirements, the aforementioned patents do not disclose a new handheld data device with cellular connectivitys. The inventive device includes a housing, designed for being grasped by a human hand, which includes a front wall and defines an interior space, a processing and storage means preferably positioned within the housing, and timing means used for determining an elapsed time, and also positioned within the housing. The timing means facilitates timing of a horse. A plurality of actuators are operationally coupled to the timing means and facilitates indication of a start time, a stop time, and a split/lap for the timing means. A stop watch display may be positioned on the front wall. The stop watch display is operationally coupled to the timing means and provides a visual indication of an elapsed time.

In these respects, the handheld data device with cellular connectivitys according to the present invention substantially departs from the conventional concepts and designs of the prior art, and in so doing provides an apparatus primarily developed for the purpose of facilitating tracking of training and handicapping for horses.

SUMMARY OF THE INVENTION

In view of the foregoing disadvantages inherent in the known types of handheld computing devices and personal data assistants now present in the prior art, the present invention provides a new handheld data device with cellular connectivitys construction wherein the same can be utilized for facilitating tracking of training and handicapping for horses.

The general purpose of the present invention, which will be described subsequently in greater detail, is to provide a new handheld data device with cellular connectivitys apparatus and method which has many of the advantages of the handheld computing devices and personal data assistants mentioned heretofore and many novel features that result in a new handheld data device with cellular connectivitys which is not anticipated, rendered obvious, suggested, or even implied by any of the prior art handheld computing devices and personal data assistants, either alone or in any combination thereof.

To attain this, the present invention generally comprises a housing, designed for being grasped by a human hand, which includes a front wall and defines an interior space, a processing and storage means preferably positioned within the housing, and timing means used for determining an elapsed time, and also positioned within the housing. The timing means facilitates timing of a horse. A plurality of actuators are operationally coupled to the timing means and facilitates indication of a start time, a stop time, and a split/lap for the timing means. A stop watch display may be positioned on the front wall. The stop watch display is operationally coupled to the timing means and provides a visual indication of an elapsed time.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handheld data device with cellular connectivitys apparatus and method which has many of the advantages of the handheld computing devices and personal data assistants mentioned heretofore and many novel features that result in a new handheld data device with cellular connectivitys which is not anticipated, rendered obvious, suggested, or even implied by any of the prior art handheld computing devices and personal data assistants, either alone or in any combination thereof.

It is another object of the present invention to provide a new handheld data device with cellular connectivities, which may be easily and efficiently manufactured and marketed.

It is a further object of the present invention to provide a new handheld data device with cellular connectivities, which is of a durable and reliable construction.

An even further object of the present invention is to provide a new handheld data device with cellular connectivitys which is susceptible of a low cost of manufacture with regard to both materials and labor, and which accordingly is then susceptible of low prices of sale to the consuming public, thereby making such handheld data device with cellular connectivitys economically available to the buying public.

Still yet another object of the present invention is to provide a new handheld data device with cellular connectivities, which provides in the apparatuses and methods of the prior art some of the advantages thereof, while simultaneously overcoming some of the disadvantages normally associated therewith.

Still another object of the present invention is to provide a new handheld data device with cellular connectivitys for facilitating tracking of training and handicapping for horses.

Yet another object of the present invention is to provide a new handheld data device with cellular connectivitys which includes A housing, designed for being grasped by a human hand, which includes a front wall and defines an interior space, a processing and storage means preferably positioned within the housing, and timing means used for determining an elapsed time, and also positioned within the housing. The timing means facilitates timing of a horse. A plurality of actuators is operationally coupled to the timing means and facilitates indication of a start time, a stop time, and a split/lap for the timing means. A stop watch display may be positioned on the front wall. The stop watch display is operationally coupled to the timing means and provides a visual indication of an elapsed time.

Still yet another object of the present invention is to provide a new handheld data device with cellular connectivitys that allows horse racing fans to obtain up-to-the-minute information regarding races.

Even still another object of the present invention is to provide a new handheld data device with cellular connectivitys that allows tracking of betting information.

Yet another object of the present invention if to provide an electronic version of a condition book for the current days races.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
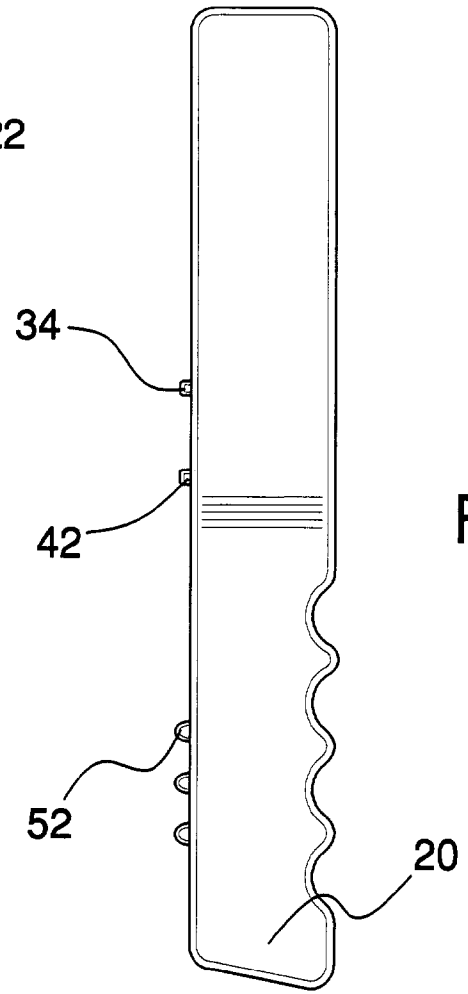
FIG. 2 is a schematic side view of the present invention.
Figure 1:
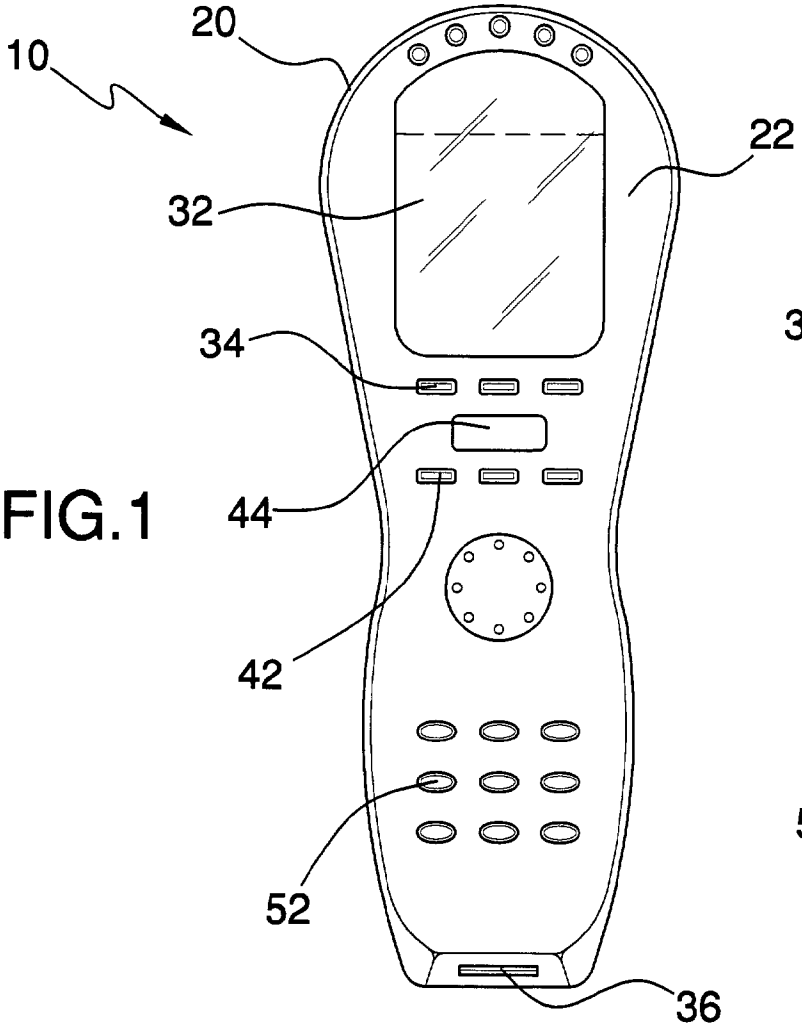
FIG. 1 is a schematic front view of a new handheld data device with cellular connectivitys according to the present invention.
Figure 3:
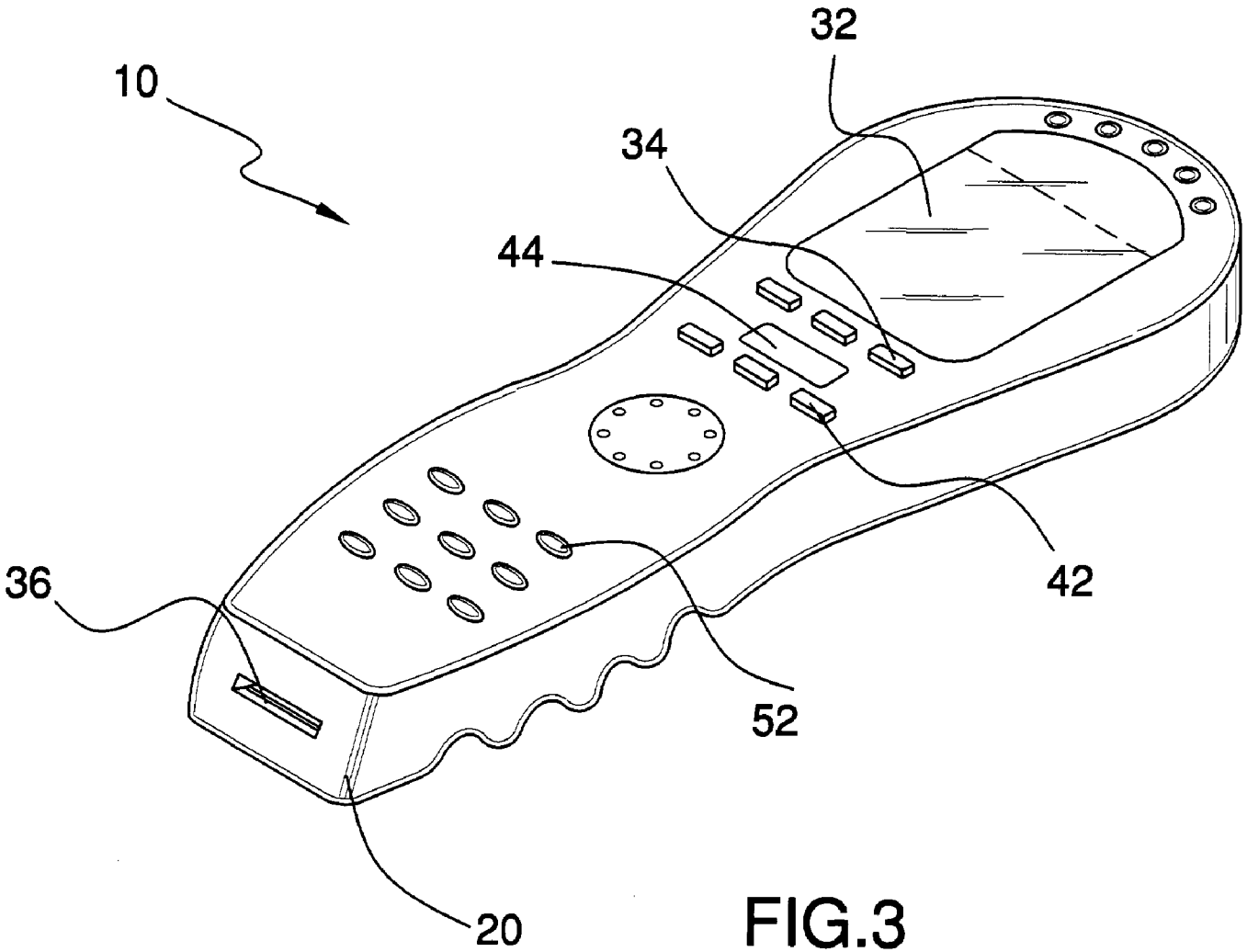
FIG. 3 is a schematic perspective view of the present invention.
Figure 4:
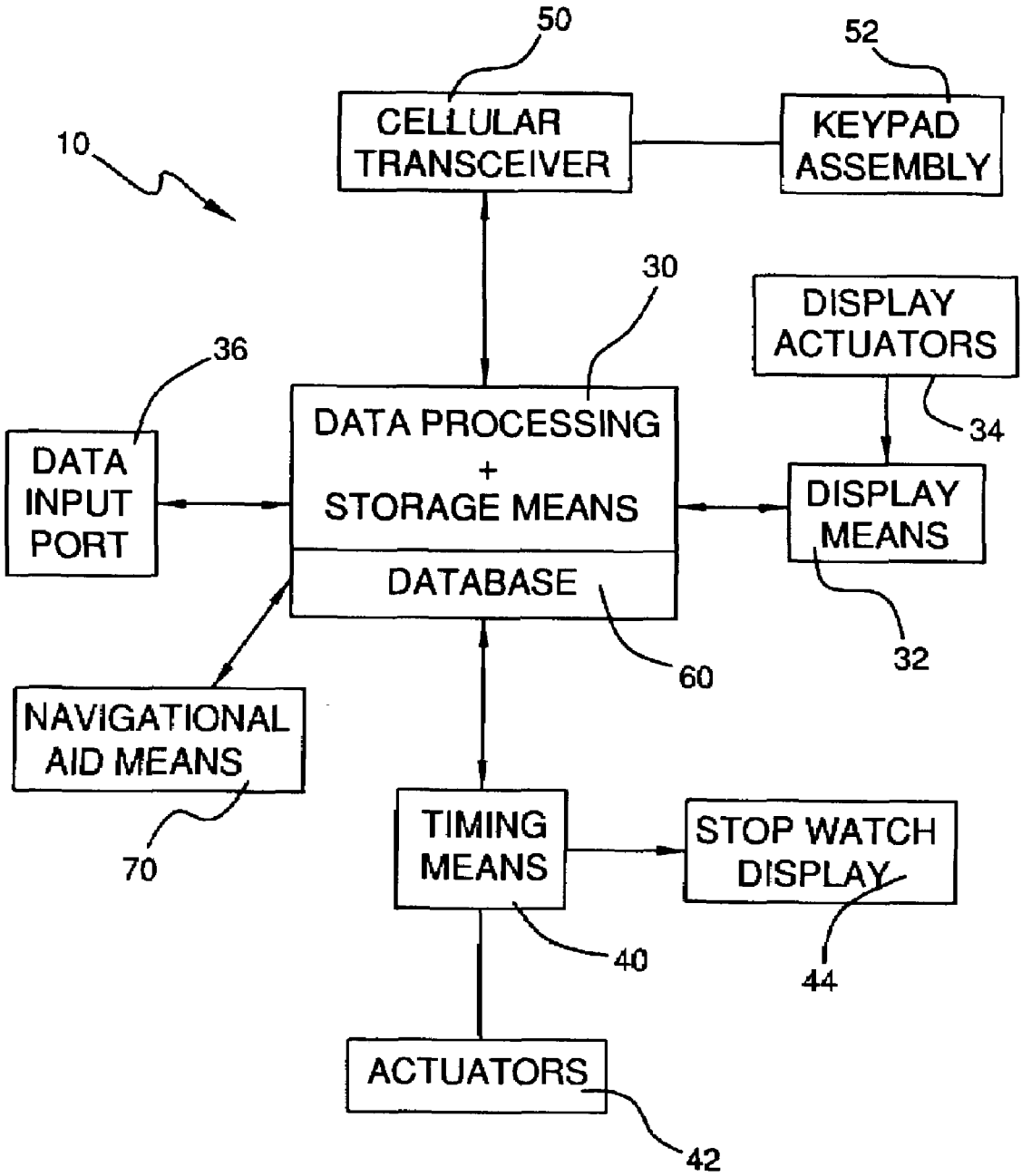
FIG. 4 is a schematic functional interconnect diagram of the present invention.

With reference now to the drawings, and in particular to FIGS. 1 through 4 thereof, a new handheld data device with cellular connectivitys embodying the principles and concepts of the present invention and generally designated by the reference numeral 10 will be described.

As best illustrated in FIGS. 1 through 4, the handheld data device with cellular connectivitys 10 generally comprises a housing 20, a processing and storage means 30, a timing means 40, a cellular transceiver 50, and a plurality of actuators 42.

The housing 20 designed for being grasped by a human hand, and defines an interior space. The housing 20 includes a front wall 22.

The processing and storage means 30 is preferably positioned within the housing 20.

The timing means 40 is used for determining an elapsed time, and is also positioned within the housing 20. The timing means 40 facilitates timing of a horse. The plurality of actuators 42 is operationally coupled to the timing means 40 and facilitates indication of a start time, a stop time, and a split/lap for the timing means 40. A stop watch may be positioned on the front wall of the housing to facilitate, for example, the timing of a horse. A stop watch display 44 may be positioned on the front wall 22. The stop watch display 44 is operationally coupled to the timing means 42 and provides a visual indication of an elapsed time. The timing means 40 may be an analog stop watch or a digital implementation within the processing and storage means 30.

A display means 32 is preferably positioned on the front wall 22 of the housing 20. The display means 32 is operationally coupled to the processing and storage means 30 and presents information relevant to the horse or a track being used by the horse. The information is stored by the processing and storage means 30. A plurality of display actuators 34 may also be positioned on the front wall 22 adjacent to the display means 32, for facilitating selecting and acting upon the information presented on the display means 32. The plurality of display actuators 34 is operationally coupled to the processing and storage means 30.

A data input port 36 may extend through a wall of the housing 20 and be operationally coupled to the processing and storage means 30. The data input port 36 facilitates importing and exporting of data to and from the processing and storage means 30.

In an embodiment the data input port 36 is a universal serial bus (USB) port.

The cellular transceiver 50 is also preferably positioned within the housing 20. The cellular transceiver 50 facilitates communication between the device 10 and conventional cellular telecommunications facilities. A keypad assembly 52 may be positioned on the front wall 22 of the housing 20, to facilitate utilization of the cellular transceiver 50.

In a further embodiment, the keypad assembly 52 is operationally coupled to the processing and storage means 30 for facilitating input of data by a user to the processing and storage means 30.

The device 10 may include a database 60 stored in and manipulated by the processing and storage means 30. The database 60 is for storing, processing, and accessing information relevant to a plurality of animals, facilities, trainers, and jockeys.

In still a further embodiment, a navigational aid means 70 is positioned within the housing 20 and provides compass indications of direction for a user. Illustrative examples of the navigational aid means 30 may include a GPS receiver, radio compass, or compass.

In a preferred embodiment the housing 20 includes a first end 24 and a second, end 26. The first end 24 includes a width of approximately 2 and $\frac{7}{8}^{th}$ inches. The second end 26 includes a width of approximately 1¼ inches. The housing 20 includes an overall length of 6½ inches.

In yet a further embodiment the cellular transceiver 50 is for receiving data transmissions displayable on the display means 32. The types of data transmissions may include, but certainly are not limited to: race results, weather forecast, weather report, news, stock quotes, advertisements, horoscopes, betting information, local interest information, and dating service announcements.

In a preferred embodiment, the transceiver 50 is for receiving data transmissions displayable on the display means 32 for providing an electronic version of the condition book for the current days races.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handheld data device for use in conjunction with equestrian activities comprising:

a housing adapted for being grasped by a human hand, said housing defining an interior space, said housing having a front wall;

a processing and storage means positioned within said housing;

a stop watch positioned on said front wall of said housing, said stop watch facilitating timing of a horse;

a display means positioned on said front wall of said housing, said display means being operationally coupled to said processing and storage means, said display means presenting information relevant to the horse or a track being used by the horse, said information being stored by said processing and storage means;

a cellular transceiver positioned in said housing for permitting communication between said device and cellular telecommunications facilities;

a keypad assembly positioned on a front wall of said housing, said keypad assembly facilitating utilization of said cellular transceiver; and wherein said keypad assembly being operationally coupled to said processing and storage means for facilitating input of data by a user to said processing and storage means.

2. The device of claim 1, further comprising a plurality of actuators positioned on said front wall adjacent to said display means, said plurality of actuators facilitating selecting and acting upon said information presented on said display means, said plurality of actuators being operationally coupled to said processing and storage means.

3. The device of claim 1, wherein said stop watch further comprises:

a timing means for determining an elapsed time;

a plurality of actuators operationally coupled to said timing means, said plurality of actuators facilitating indication of a start time, a stop time, and a split/lap for said timing means; and a stop watch display positioned on said front wall, said stop watch display being operationally coupled to said timing means, said stop watch display providing a visual indication of an elapsed time.

4. The device of claim 1, further comprising a data input port extending through a wall of said housing, said data input port being operationally coupled to said processing and storage means, said data input port facilitating importing and exporting of data to and from said processing and storage means.

5. The device of claim 4, wherein said data input port being a universal serial bus (USB) port.

6. The device of claim 1, further comprising a database stored in and manipulated by said processing and storage means, said database being for storing, processing, and accessing information relevant to a plurality of animals, facilities, trainers, and jockeys.

7. The device of claim 1, wherein said housing includes a rear wall and a pair of opposite side walls; and wherein a plurality of grooves are formed in the rear wall and extend from a first one of the side walls to a second one of the side walls.

8. The device of claim 1, wherein said housing includes an upper portion, a lower portion, and a medial portion between said upper and lower portions, said middle portion having a width smaller than a width of said upper portion and a width of said lower portion.

9. The device of claim 1, wherein said housing includes a rear wall and a pair of opposite side walls; and wherein a plurality of grooves are formed in the rear wall and extend from a first one of the side walls to a second one of the side walls;

wherein said housing includes an upper portion, a lower portion, and a medial portion between said upper and lower portions, said middle portion having a width smaller than a width of said upper portion and a width of said lower portion.

10. A handheld data device for use in conjunction with equestrian activities comprising:

a housing adapted for being grasped by a human hand, said housing defining an interior space, said housing having a front wall;

a processing and storage means positioned within said housing;

a timing means for determining an elapsed time positioned within said housing facilitating timing of a horse;

a plurality of actuators operationally coupled to said timing means, said plurality of actuators facilitating indication of a start time, a stop time, and a split/lap for said timing means; and a stop watch display positioned on said front wall, said stop watch display being operationally coupled to said timing means, said stop watch display providing a visual indication of an elapsed time;

a display means positioned on said front wall of said housing, said display means being operationally coupled to said processing and storage means, said display means presenting information relevant to the horse or a track being used by the horse, said information being stored by said processing and storage means;

a plurality of actuators positioned on said front wall adjacent to said display means, said plurality of actuators facilitating selecting and acting upon said information presented on said display means, said plurality of actuators being operationally coupled to said processing and storage means;

a data input port extending through a wall of said housing, said data input port being operationally coupled to said processing and storage means, said data input port facilitating importing and exporting of data to and from said processing and storage means, wherein said data input port being a universal serial bus (USB) port;

a cellular transceiver positioned within said housing, said cellular transceiver facilitating communication between said device and cellular telecommunications facilities;

a keypad assembly positioned on a front wall of said housing, said keypad assembly facilitating utilization of said cellular transceiver;

wherein said keypad assembly being operationally coupled to said processing and storage means for facilitating input of data by a user to said processing and storage means; and a database stored in and manipulated by said processing and storage means, said database being for storing, processing, and accessing information relevant to a plurality of animals, facilities, trainers, and jockeys.

11. The device of claim 10, further comprising a navigational aid means positioned within said housing, said navigational aid means providing compass indications of direction for a user.

12. The device of claim 10, wherein said housing having a first end and a second, end, said first end having a width of approximately 2 and ⅞$^{th}$ inches, said second end having a width of approximately 1¼ inches, said housing having an overall length of 6½ inches.

13. The device of claim 10, wherein said cellular transceiver being for receiving data transmissions displayable on said display means.

14. The device of claim 13, wherein said data transmissions being selected from the group of data transmissions consisting of race results, weather forecast, weather report, news, stock quotes, advertisements, horoscopes, betting information, local interest information, and dating service announcements.

15. The device of claim 13, wherein said data transmissions consist of a condition book associated with a current day's races.

16. The device of claim 10, further comprising:

a navigational aid means positioned within said housing, said navigational aid means providing compass indications of direction for a user;

wherein said housing having a first end and a second, end, said first end having a width of approximately 2 and ⅞$^{th}$ inches, said second end having a width of approximately 1¼ inches, said housing having an overall length of 6½ inches;

wherein said cellular transceiver being for receiving data transmissions displayable on said display means;

wherein said data transmissions being selected from the group of data transmissions consisting of race results, weather forecast, weather report, news, stock quotes, advertisements, horoscopes, betting information, local interest information, and dating service announcements.

17. The device of claim 10, further comprising a navigational aid means positioned within said housing, said navigational aid means providing compass indications of direction for a user;

wherein said housing having a first end and a second, end, said first end having a width of approximately 2 and ⅞$^{th}$ inches, said second end having a width of approximately 1¼ inches, said housing having an overall length of 6½ inches;

wherein said cellular transceiver being for receiving data transmissions displayable on said display means;

wherein said data transmissions being selected from the group of data transmissions consisting of race results, weather forecast, weather report, news, stock quotes, advertisements, horoscopes, betting information, local interest information, and dating service announcements;

wherein said data transmissions consist of a condition book associated with a current day's races;

a navigational aid means positioned within said housing, said navigational aid means providing compass indications of direction for a user;

wherein said housing having a first end and a second, end, said first end having a width of approximately 2 and ⅞$^{th}$ inches, said second end having a width of approximately 1¼ inches, said housing having an overall length of 6½ inches;

wherein said cellular transceiver being for receiving data transmissions displayable on said display means;

wherein said data transmissions being selected from the group of data transmissions consisting of race results, weather forecast, weather report, news, stock quotes, advertisements, horoscopes, betting information, local interest information, and dating service announcements;

wherein said housing includes a rear wall and a pair of opposite side walls; and wherein a plurality of grooves are formed in the rear wall and extend from a first one of the side walls to a second one of the side walls;

wherein said housing includes an upper portion, a lower portion, and a medial portion between said upper and lower portions, said middle portion having a width smaller than a width of said upper portion and a width of said lower portion.

* * * * *